United States Patent [19]

Schäffler

[11] 4,096,959

[45] Jun. 27, 1978

[54] GARBAGE COLLECTING AND TRANSPORT VEHICLE

[75] Inventor: Georg Schäffler, Augsburg, Germany

[73] Assignee: Industrie-Werke Karlsruhe Augsburg Aktiengesellschaft, Germany

[21] Appl. No.: 730,315

[22] Filed: Oct. 7, 1976

[30] Foreign Application Priority Data

Oct. 8, 1975 Germany ..... 2545051

[51] Int. Cl.[2] ..... B65F 3/02

[52] U.S. Cl. ..... 214/302; 214/83.3

[58] Field of Search ..... 214/152, 82, 83.3, 301, 214/302, 313, 516

[56] References Cited

U.S. PATENT DOCUMENTS

| | | | |
|---|---|---|---|
| 3,006,492 | 10/1961 | Haughton | 214/82 |
| 3,202,305 | 8/1965 | Dempster et al. | 214/302 |
| 3,370,525 | 2/1968 | Bowles | 214/83.3 |

FOREIGN PATENT DOCUMENTS

| | | | |
|---|---|---|---|
| 678,987 | 12/1964 | Italy | 214/83.3 |

*Primary Examiner*—Lawrence J. Oresky
*Attorney, Agent, or Firm*—McGlew and Tuttle

[57] ABSTRACT

A garbage collecting and transport vehicle, includes a chassis supporting a changing container which receives garbage which is picked up by a pivotal garbage can loader arm which is mounted on the chassis so as to be pivotal through an arc to raise the garbage can containing the garbage, and invert the can to dump it into a garbage loader housing which is located on the chassis in front of the changing container. The loader housing includes pickup blade which is pivotally mounted in the garbage loading housing to move it up to the level of a transfer opening which aligns with an inlet opening on the changing container. The closing blade which in one position closes the opening is first moved to a position in which it closes the inlet to the loader housing and, after the garbage is picked up by the pickup blade, it moves back to the transfer opening and pushes the garbage into the changing container. The pivotal garbage can loader is advantageously designed as a one-arm member arranged on one side of the driver's cabin, and it is provided with a crossbeam at the outer end of the loader arm which pivotally supports garbage can support arms and which is rotatable to cause inversion of the garbage can so that its head is positioned downwardly into the top opening of a loader housing in order to dump the garbage into the housing.

9 Claims, 21 Drawing Figures

GARBAGE COLLECTING AND TRANSPORT VEHICLE

FIELD AND BACKGROUND OF THE INVENTION

This invention relates in general to the construction of garbage collecting and transport vehicles and, in particular, to a new and useful garbage collecting and transport vehicle which has a loader housing with a top opening located behind a cabin in a position to receive garbage dumped from cans which are raised by a pivotal garbage can loader arm and which has means in the loader housing for transferring the garbage which is dumped into the housing from the cans through a transfer opening which communicates with an inlet opening of a changing container.

DESCRIPTION OF THE PRIOR ART

German Pat. No. 1,272,216 describes a garbage truck wherein the collecting container, which is arranged behind the driver's cabin, can be dumped to the rear of the vehicle for emptying. The garbage, which is contained in a large capacity container, is fed according to this patent by means of an overhead loader arranged at the front of the truck to a loading chamber which is an integral part of the collecting container. A pickup blade or hoisting blade is arranged on the bottom of the loading chamber. The hoisting blade receives its rotary movement transverse to the longitudinal axis of the truck by means of hydraulic lifting cylinders. The garbage arriving in the loading chamber during the emptying of a large capacity garbage container drops thus at first onto the hoisting blade. When the hoisting blade loaded with garbage is raised, a pressure blade, which is rotatably mounted transverse to the longitudinal axis of the truck and which can be swiveled by means of hydraulic lifting cylinders, engages the garbage and conveys it into the interior of the collecting container, which is closed at its rear end by a cover. In order to empty the collecting container, the container, including its hoisting and lifting blade assembly, is raised by means of an additional hydraulic lifting cylinder arrangement about a swivel axis provided at the rear end of the chassis, and the rotatably mounted container cover at the upper rear end of the collecting container is then opened to release the garbage.

In German Pat. No. 894,525, it has been suggested to hitch a trailer to a truck with a collecting container receiving the garbage, which trailer is provided with both feeding holes and garbage conveying means. The garbage which is poured into the trailer arrives by means of a conveyor in the collecting container of the truck. The trailer is provided at its front end with an opening which corresponds to an opening provided at the rear of the collecting container.

German DAS No. 1,225,546 discloses a garbage truck in which a garbage collecting tank or container is detachably mounted on the loading surface. A garbage loading device is rotatably mounted at the rear end of the truck. The garbage container is lifted from the truck or attached on it by means of a special loading gear. This makes it necessary in both cases that the loading device must be hinged down far enough to permit the container can to be attached or removed unhindered. A special auxiliary frame secured on the truck is provided for guiding the container during the attachment or detachment, and this also protects the driver's cabin at its front end against damage by the unavoidable swinging movements of the container. The emptying of the container is also effected with the loading gear. The latter must be so engaged and adjusted that the container hangs obliquely down and the flaps closing the container at the rear are also turned to the rear by the sliding garbage, after certain locks have been unlocked.

Though one or the other of the suggested garbage trucks may be in use in the present practice of communal garbage removal, solutions which are geared to the use of special loading gears for lifting a filled container or to the coupling and uncoupling of garbage feeding holes and the trailer receiving the associated conveyor screws from the garbage truck proper are no longer acceptable according to the viewpoints of modern and, particularly, economical, garbage collections.

The garbage collecting trucks suggested and discussed so far, as well as the garbage removal methods developed for their application have certain drawbacks and inconveniences. Because of the practice of daily garbage collection in the communities, they are not apt to displace the conventional methods of collecting and removing garbage and to provide a breakthrough for the principle of transferring garbage into changing containers and replacing these containers.

The same, or at least similar, criteria also apply to the so-called garbage reloading stations which work on the reemptying principle. In such a reloading station, the garbage is emptied, as known, from conventional collecting trucks in a known manner and poured in loose form. In the following conveying and compression process inside the plant, the garbage is further treated to be shipped thereafter in containers to a disposal plant, for example, a garbage incinerator.

Re-emptying methods as discussed above could not assert themselves in practice to a considerable degree either, particularly since the conceptional disadvantages outweight the advantages. Disadvantages in the sense of the foregoing considerations are, for example, the relatively high development, investment, operating and personnel costs which make them profitable only in rare cases. An adverse effect on the cost situation is the requirements by authorities that garbage rehandling places must be built over or rebuilt to make them dust, noise and odor-free. Another disadvantage is the unavoidable environment pollution and annoyance of residents in the neighborhood, as well as the fixed location which is irreparable if changes of plans would become necessary later on.

SUMMARY OF THE INVENTION

Maintaining the ideas of (a) receiving and shipping garbage in trucks with changing containers and (b) of feeding the changing containers not to conceptionally inadequate garbage reloading stations, but to so-called "container terminals", for example, by using special hauling equipment, the present invention provides an optimum universally suitable vehicle for these purposes. This solution must therefore include the separate use of the vehicle for collecting and removing the garbage, as well as the use of container terminals, if necessary, special container trucks.

This problem is solved according to the present invention by arranging the changing container on the chassis so that it can be freely removed to the rear and/or dumped separately, and so that it forms a functional unit with the loading gear secured on the chassis between the driver's cabin and the changing container, during the loading operation, and by feeding the garbage to the loading gear by means of an overhead loader and conveying it by means of swivel blades of the loading gear to the changing container by means of a rotatably mounted pressure and closing blade which is advantageously associated with or mounted at the inlet of the changing container, but which extends into the transfer opening of the loading gear housing.

In a logical development of the invention, the pressure- and loading blade closes the changing container in the detached and/or dumped state. A further development of the suggested invention consists in that the overhead loader comprises a pivotal loader which is pivotally mounted on only one side of the truck or driver's cabin. The swivel element is advantageously provided with a crossbeam having arms extending outwardly therefrom, serving to receive a garbage can etc., which can be turned by about 90° about a horizontal axis so as to invert the can as it is lifted through an arc for dumping its contents into the loader housing.

The suggested invention has a number of advantages which refer not only to the design of the garbage collecting and transport vehicle as such, but which generally have favorable influences on the principle of garbage collecting and disposal with changing containers. This essential influence has only become possible, however, since the loading gear, which was heretofore rigidly connected with the garbage container, and which was raised during the emptying together with the latter, is now secured according to the intentions of the invention of the chassis of the vehicle, while the container is designed as a changing container which can be freely detached to the rear and dumped separately. The pressure-and loading blade may also serve to close the changing container in the detached and/or dumped state and, for this purpose, it is pivotally supported on the changing container.

The resulting principal advantages are evident because it is possible for the first time in practice with the suggested vehicle to collect primarily only the garbage, to deposit the changing container on a central "container terminal" in the inner city, and to replace it by an empty container and to immediately continue the collection of the garbage on the principle of the shortest route and optimum utilization and movement of the vehicle. From the "container terminal", the changing containers collected there during a work day are shipped to the garbage depot, etc., with a truck which can hold several containers, which utilize low-traffic periods for movement. This garbage collecting-and shipping principle permits the simultaneous use of a plurality of garbage collecting trucks, while using a far smaller number of transport vehicles. Naturally, these trucks can also remove the changing containers accumulating during the day in the container terminal without interruption.

In view of the costs required for the purchase of these transport vehicles for communities, it is readily possible to forego or postpone the purchase at first and not only to collect the garbage with the collecting truck, but also to transport it to the garbage disposal plant and to empty it there with the slide-dumping device secured on the truck. It is thus quite possible to work at low cost with the application of the suggested invention, by procuring first one (or more) garbage collecting trucks and to supplement them later after (partial amortization, by the purchase of a transport vehicle for changing containers. The building and equipment of containter terminals also has considerable advantages for the total principle of garbage collecting and shipping. Such a changing container terminal requires only a simple deposit area for the full and empty containers. Neither stationary foundations, nor ramps, crane installations or operating personnel are required. If a container terminal has to be removed, for example, by communal space planning, this is readily possible by using the concept of the invention, and the costs required are practically nil.

Furthermore, special attention has been paid to the proper design of the overhead loader within the framework of the suggested invention, since it is designed as a one-arm swivel element to save space, and is mounted only on one side of the truck or driver's cabin. Beyond that, the arrangement of a crossbeam on the overhead loader to receive the garbage can is of special advantage because this beam can be turned by 90° by means of a joint in the receiving position of the can. This way, a garbage can standing at the curb or in inaccessible places can be readily engaged without any manual operation, and its contents transferred to the loading gear.

Accordingly, it is an object of the invention to provide an improved method for handling garbage using a collection vehicle which has a load charging housing disposed on it behind the vehicle cabin and means for securing a changing container to the rear of the charging housing, and which comprises picking up garbage from cans, dumping it into the charging housing and utilizing the driving mechanism in the housing for moving the garbage into the changing container periodically as the garbage is picked up and, thereafter, depositing filled changing containers at a collection center located within the area in which the garbage is collected, and periodically removing the changing containers using a transport truck from the selection center and transporting them to a dumping center and dumping each container at the location of the dumping center.

A further object of the invention is to provide a collection and transport vehicle for garbage which comprises a chassis containing a driver's cabin at one end and having a load charging housing and load loading gear therein arranged so that a transfer opening of the load charging housing aligns with an inlet opening of the changing container, and which includes means associated therewith for lifting the garbage from the loading housing and presenting it in a position in which it can be transferred through the transfer opening to the changing housing.

Another object of the invention, is to provide a combined garbage collecting vehicle and transport vehicle which includes means for accommodating one or more garbage receiving containers which advantageously have inlet openings with closing flaps pivoted to the upper end of the openings which are alignable with a fixed garbage loading housing which has a transfer opening into which the closing flap extends and wherein the loading housing includes a top opening for receiving garbage dumped from a garbage can and a pickup blade mounted in the garbage loading housing which is pivotal through an arc to pick up the garbage dumped therein and position it at the height of the transfer opening and wherein the closing blade of the changing container is movable through an arc to position it above the garbage picked up by the pickup blade and then to move downwardly to direct the garbage into the garbage receiving container.

A further object of the invention is to provide a transport vehicle having means for storing a plurality of garbage receiving containers and which includes means for pivoting each container so as to dump it from the rear end thereof and to transfer and lift the container downwardly from the chassis of the vehicle for deposit or for picking up the garbage receiving container for loading onto the transport truck.

Another object of the invention is to provide a garbage collecting and transport vehicle, which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENTS

Figure 1:
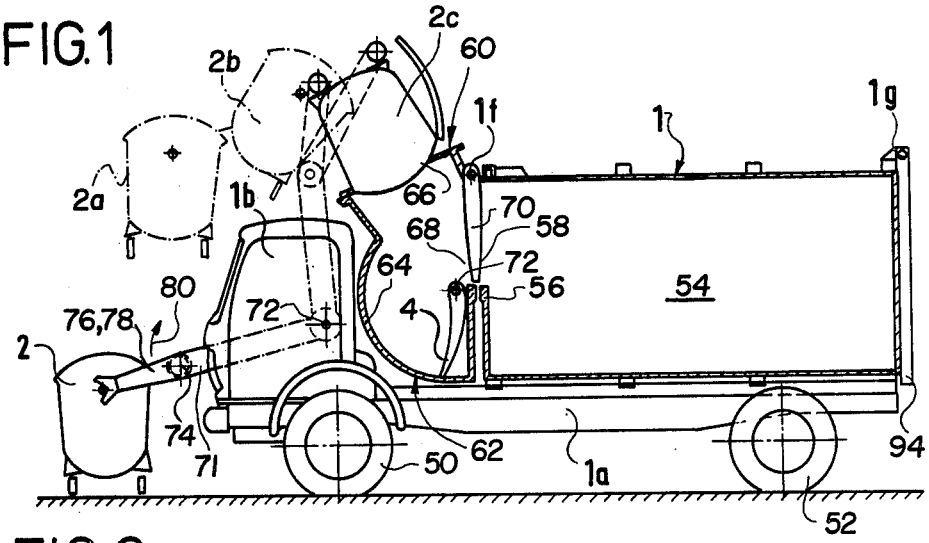
FIG. 1 is a partial longitudinal sectional view and side elevational view of a garbage collecting and transport vehicle constructed in accordance with the invention.

Referring to the drawings in particular, the invention embodied therein in FIGS. 1 through 7, comprises a garbage collecting truck, generally designated 1, which includes a chassis 1a which is supported on front and rear sets 50 and 52 and which includes a cabin 1*b* at the forward end of the chassis.

In accordance with the invention, a single changing container 54 is detachably engageable on chassis 1a and it includes a front wall 56 having a front loading opening or inlet 58 adjacent the top thereof. The changing container 54 is accommodated on chassis 1a directly to the rear of a garbage loading gear, generally designated 60, which includes a load charging housing 62 having a curved bottom 64 and an oblique opening 66 adjacent the top thereof. In addition, the load charging device housing 62 includes a transport opening 68 through which garbage is passed into the inlet 58 of the single charging container 54.

Figure 4:
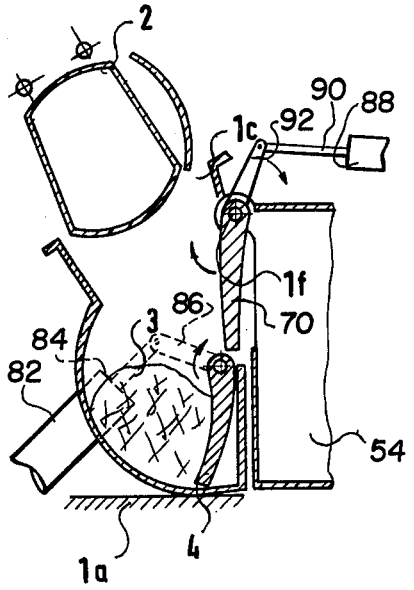
FIGS. 4, 5, 6 and 7 are enlarged partial sectional views showing the interengagement and operation of the load charging housing and changing container indicating the various stages of operation for transferring the garbage from the load charging housing to the changing container.
Figure 5:
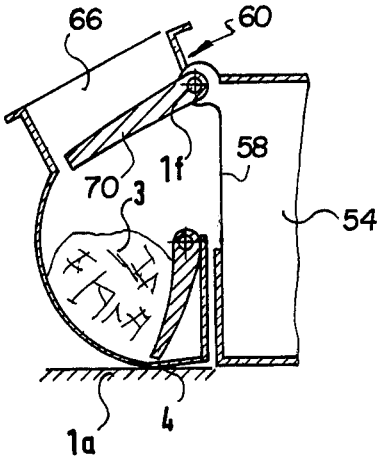
Figure 6:
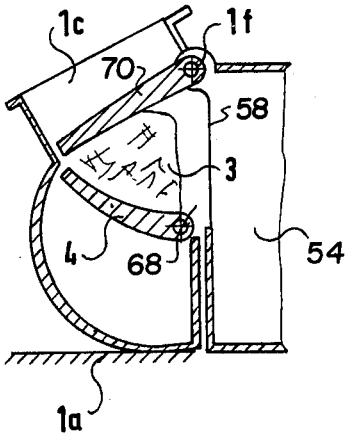
Figure 7:
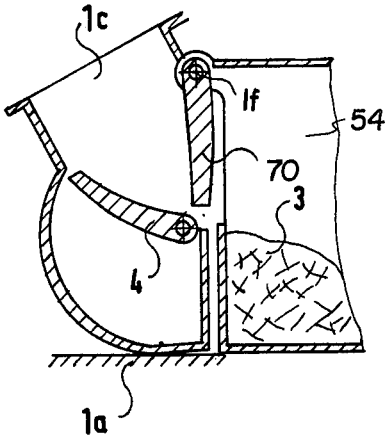

In accordance with a feature of the construction, the charging container 54 has a pivotal mounting 1f for a closing blade 70 which is of a length to close the inlet 58 as well as the transport opening 68 of the load charging device 60. In addition, the load charging device includes a pickup blade 4 which is pivotally mounted at 72 which is adjacent the bottom end of the transport opening 68. Pickup blade 4 is of a length to extend to the curved bottom 64 and it is movable through an arc so that its edge glides along the curved bottom and picks up any garbage 3 dumped therein and moves it upwardly to the height of the transport opening 68, as shown in FIGS. 4 and 6. Before the garbage is picked up, however, the closing blade 70 is moved from the closing position shown in FIG. 4 to the position opening the inlet 58, as shown in FIG. 5. In this position, closing blade 70 closes the oblique top opening 66 of charging device 60. In this position, as shown in FIGS. 5 and 6 of the drawings, the garbage 3 may be oriented below closing blade 70, supported on pickup blade 40, and in alignment with inlet 58 and transport opening 68. The closing blade 70 is then moved to a closing position, as shown in FIG. 7 once again, at which time it pushes the garbage off pickup blade 4 and into receiving container 54.

In accordance with a feature of the invention, the load charger 60 is charged with garbage which is picked up and dumped from garbage cans 2. This is accomplished by a pivotal garbage can loader arm 71 which is secured to a fluid pressure rotated shaft 72 which is either rotatably mounted directly on chassis 1a or on a portion of the cabin 1b. The crossbeam 74 is rotatably journalled at the end of arm 71 and it is advantageously rotated at the journalling by suitable cam means or connecting chains during the rotation of shaft 72 and the pivoting of arm 71 about the axis of shaft 72. Rotation of crossbeam 74 effects a pivoting movement of support arms 76 and 78 which engage with garbage can 2. This makes it possible to pivot the garbage can by pivoting of the arms 76 and 78 in the direction of an arrow 80, as indicated in FIG. 1, during its lifting by the pivoting of the garbage can loader arm 71 from a ground lifting position shown in solid lines to an upward dumping position, shown in dotted lines in FIG. 1. The garbage can successively moves from a solid line position shown in FIG. 1 to the dotted line positions 2*a*, 2*b* and finally to a solid line dumping position 2*c*, as shown in FIG. 1. During this time, the garbage can sidewall contacts the crossbeam 74 and increased tilting movement of arms 76 and 78 invert the can and position its mouth downwardly in the receiving opening 66 of loader 60.

The pickup blade 4 is advantageously moved by a fluid pressure driven cylinder and piston combination 82 having a piston rod portion 84 connecting a crank 86 affixed to the pickup blade 4. Similarly, a fluid pressure piston 88 operates a piston rod 90 connected to a crank 92 affixed to closing arm 70.

Figure 2:
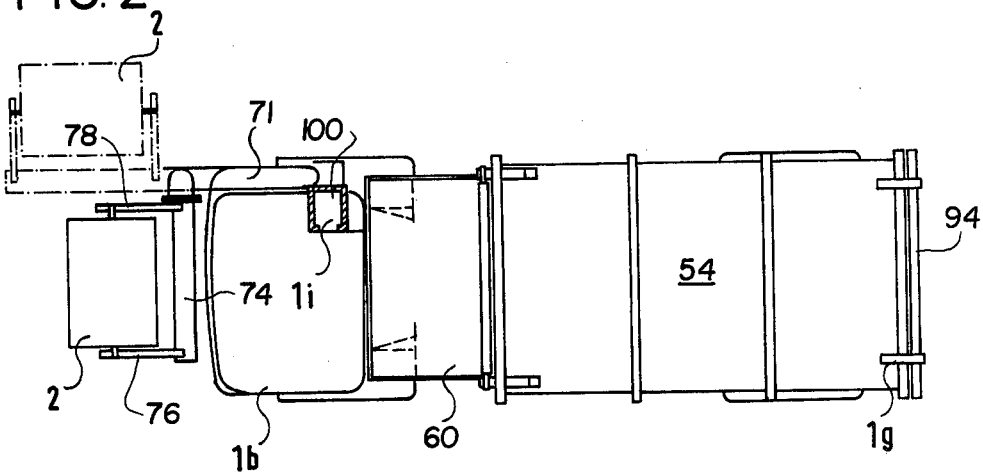
FIG. 2 is a top plan view of the device shown in FIG. 1 and showing a pivotal adjustment of the crossbar for supporting garbage cans.
Figure 3:
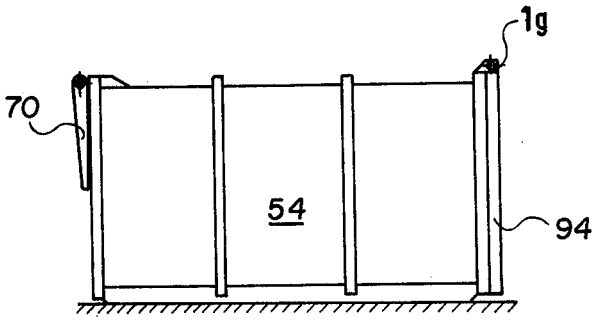
FIG. 3 is a side elevation view of a single changing container.

The closing container, as shown in FIGS. 1, 2 and 3, includes an opposite end from the loading inlet end which is provided with a closing gate 94 which is pivoted at its upper end at 1g on the closing container 54. Suitable lock means (not shown) are provided for locking gate 94 in a closed position. Crossarm 74 is mounted on arm 71 so that it may be shifted from a position perpendicular to arm 71 to a position in alignment therewith, as indicated in dotted lines in FIG. 2. The overhead loader is advantageously designed with one arm 71 which is mounted only on one side of the truck driver's cabin 1b. For this purpose, a structural element 100 is provided, which is secured either to cabin 1b or directly to chassis 1a. The closing blade 70 is indicated as being carried by the receiving container 54 but, of course, this blade could be carried by the charging device 60 and operating by operating mechanism contained on this device, if desired.

Figure 8:
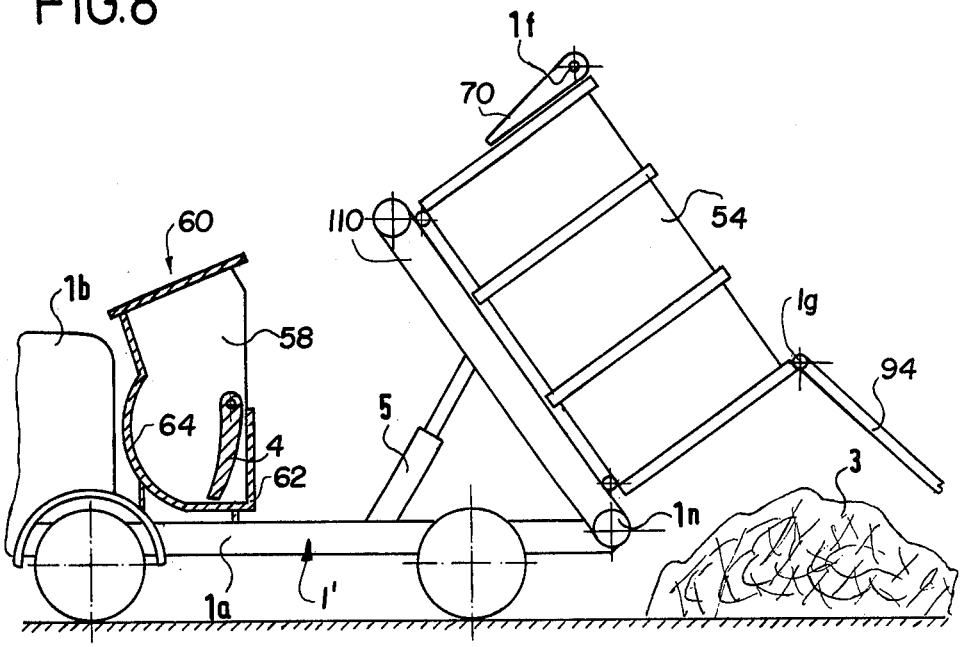
FIG. 8 is a side elevation view, partly in longitudinal section, similar to FIG. 1, but of another embodiment of the invention.

FIG. 8 illustrates the separation of the loading gear 60 in an embodiment in which the vehicle 1' has a chassis with a fluid pressure operated conveyor lift 5 for lifting and lowering a conveyor platform 110 which provides a space for the mounting of a garbage receiving container 54'. With such an embodiment, after the container 54' is filled, it may be easily dumped by raising support conveyor 110.

Figure 9:
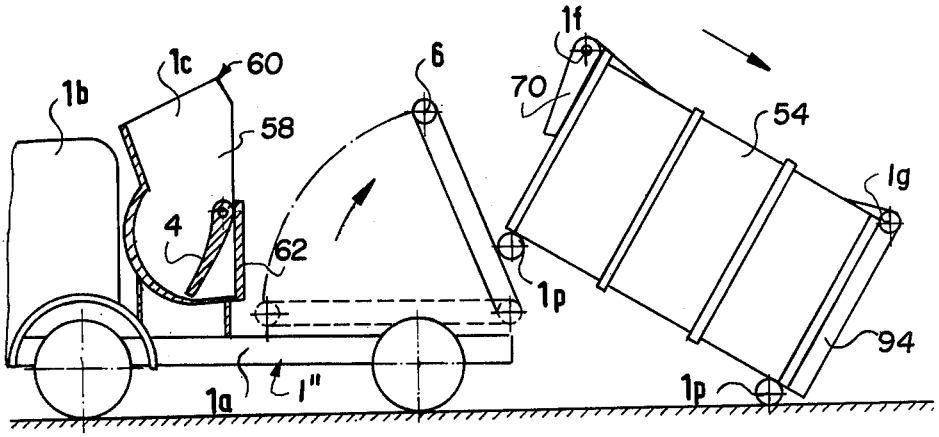
FIG. 9 is a view, similar to FIG. 8, of still another embodiment of the invention.
Figure 10:
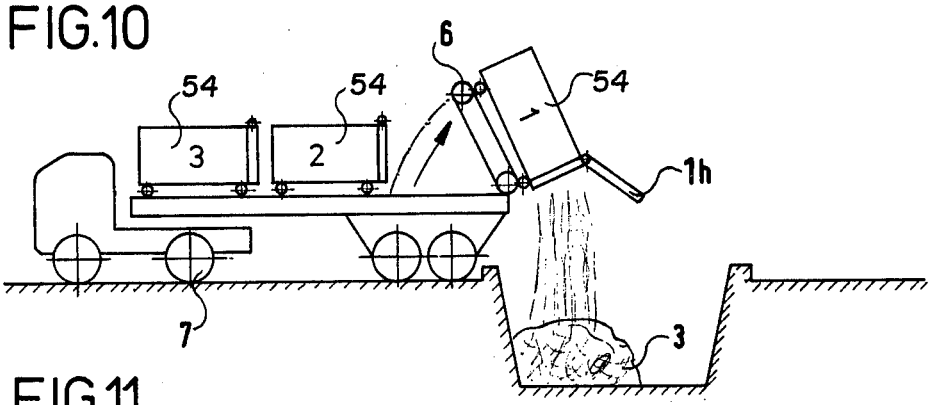
FIGS. 10, 11, 12 and 13 show the operation of a transport vehicle for effecting the dumping of single receiving containers; the unloading of the receiving containers, and the loading of the receiving containers.

FIG. 9 shows a modified construction over that of FIG. 8, wherein, a conveyor lifter 6 is provided instead of the pressure operated lift 5. In this embodiment, container 54'' is provided with rollers **1*p*, 1*p***, which facilitate its rolling-off movement for temporary parking or for permanent removal and the pickup of another container.

Figure 11:
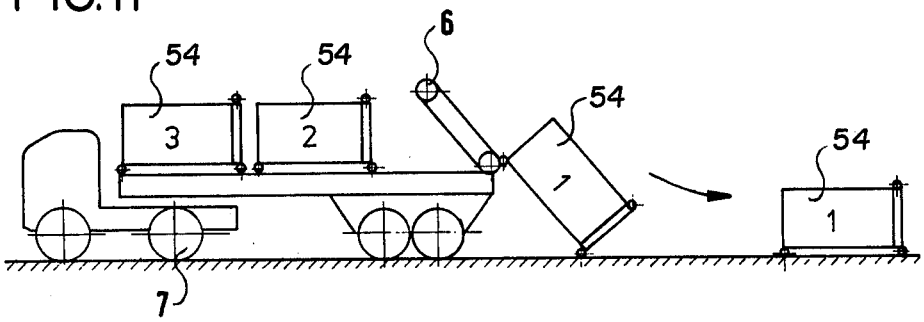
Figure 12:
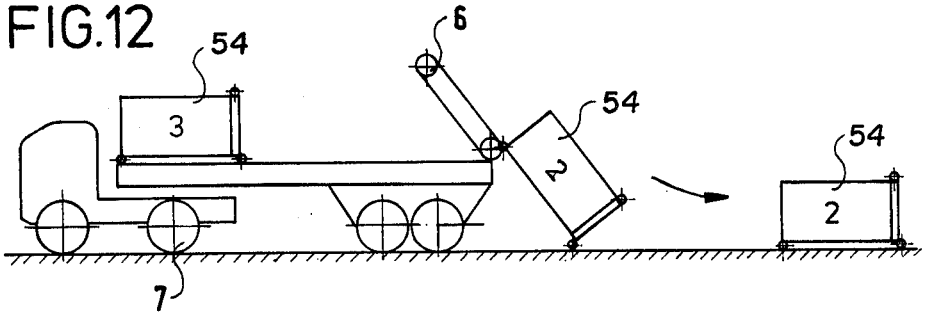
Figure 13:
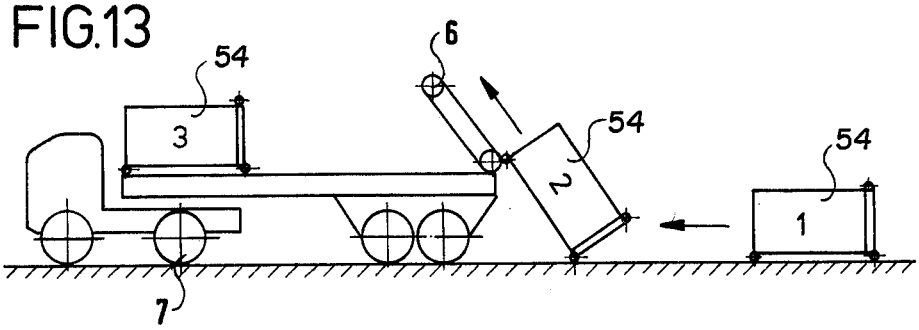
Figure 14:
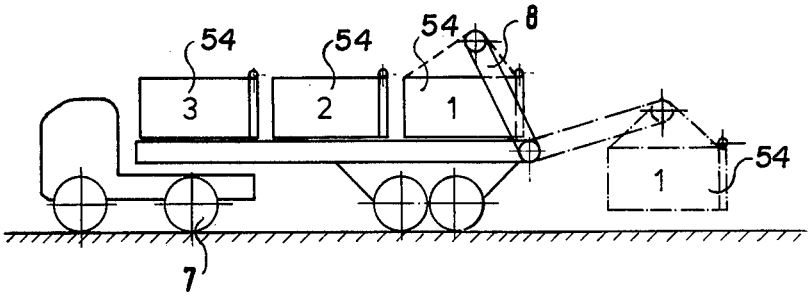
FIGS. 14 and 15 are views similar to FIGS. 10 to 13, but showing another embodiment of transport vehicle.
Figure 15:
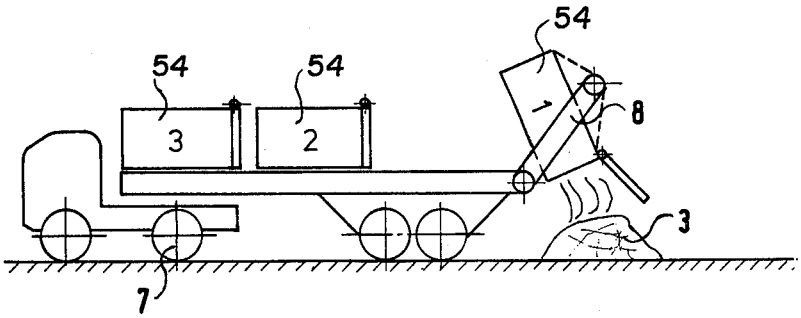
Figure 16:
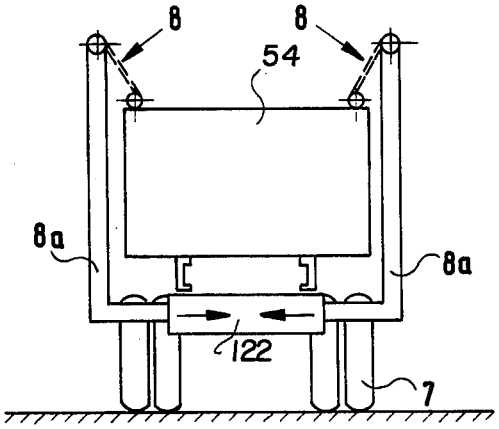
FIG. 16 is a rear elevational view of a transport vehicle similar to that shown in FIGS. 14 and 15 having laterally adjustable side arms.

FIGS. 10 to 13 show a tractor-trailer 7 having chassis designed for accommodating a plurality of garbage receiving containers 54, as indicated at 1, 2 and 3 of these figures. The device 6 at the trailing end of each of the trailer portions provides means for dumping or lifting or lowering each one of the containers which may be stowed along the length of the trailer. FIGS. 10 to 13 show a vehicle, for example, a semi-trailer, with an attachment piece for shipping changing containers which are filled with garbage 3. First the container next to the rear of the vehicle is tilted, emptied and deposited, as shown in FIG. 11. In the same manner, the other containers are moved along on the trailer portion of the tractor-trailer 7 in a reverse order in which they were loaded. This is effected by the lifting and dumping device 6. A similar arrangement is indicated in FIGS. 14 and 15 using a deposit-dumping device 8 in which the individual containers 1, 2 and 3 are either lifted, or tilted and dumped. A rear view of the vehicle is indicated at FIG. 16, which shows that the receiving container 54 may be suspended on one or more of the deposit-dumping devices 8. Each device includes an arm **8*a* which is mounted in a cylinder 122 so as to be shiftable laterally inwardly and outwardly. Instead of the slide or deposit dumping principle, it is also possible to use the known principle of the racking and the changing of containers 54**.

Figure 17:
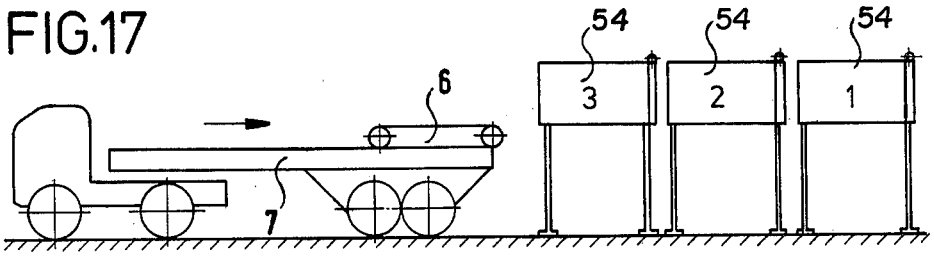
FIGS. 17, 18, 19 and 20 show a transport vehicle arranged for receiving, unloading and depositing racked changing containers as well as for emptying such changing containers according to a slide-dumping principle.
Figure 18:
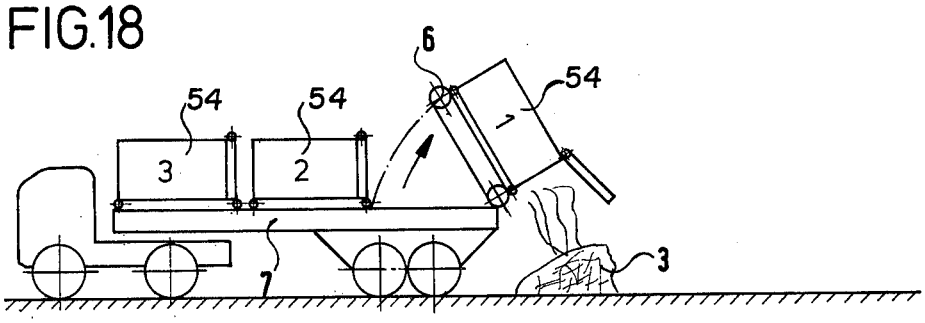
Figure 19:
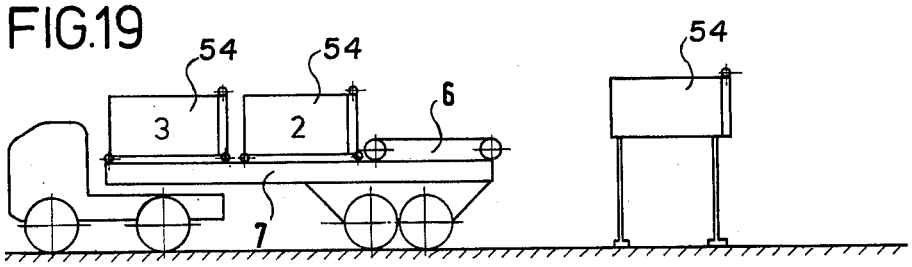
Figure 20:
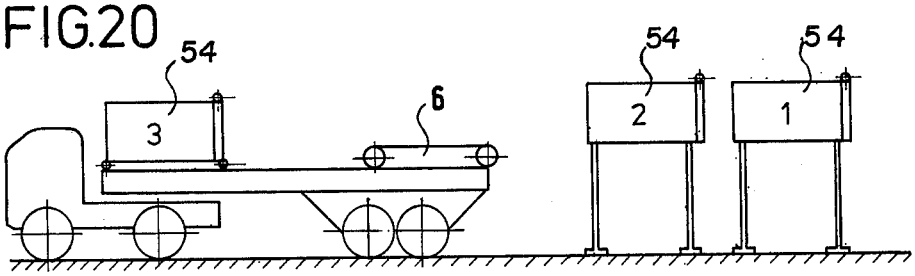

As shown in FIG. 17, the transport vehicle 7 moves on the racked containers **1*d*, which are also designated 1, 2 and 3. Transport vehicle 7 moves under the containers which are emptied. The emptying is effected by means of a slide dumping device 6, which is carried on the vehicle, as shown in FIG. 18. The empty container 1d is then deposited on the stand and the next container is pulled by means of the slide dumping device 6 into the emptying position and is emptied again and placed on the stand. After all of the containers 1d have been emptied and deposited, they are received again one by one by transport vehicle 7**.

Figure 21:
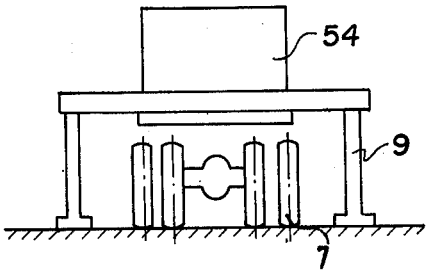
FIG. 21 indicates a garbage transport vehicle according to FIGS. 17 to 20 with a racked changing container.

FIG. 21 shows approximately the proportions of the garbage container **1*d* of the stand arrangement 9 and of the chassis 1*a*. The loading gear may be installed in a stationary manner on the chassis 1 underneath a garbage discharge shaft, for example, and the changing containers 8** may be oriented to cooperate with such discharge shaft.

While specific embodiments of the invention have been shown and described in detail to illustrate the application of the principles of the invention, it will be understood that the invention may be embodied otherwise, without departing from such principles.

What is claimed is:

1. A garbage collecting and transport vehicle for loading garbage from a garbage can or similar container, comprising a wheeled chassis having a driver's cabin at one end of said chassis, a removable garbage receiving container adapted to be positioned on said chassis having one end with a garbage receiving opening facing toward the driver's cabin, a garbage loading housing mounted on said chassis adjacent said cabin and having a top with a garbage receiving opening and an end opposite to the end facing said driver's cabin with a transfer opening adapted to align with the garbage receiving opening for the transfer of garbage from the garbage loading housing to said garbage receiving container, a pivotal garbage can loader arm pivotally mounted on said chassis for pivotal movement about a horizontal axis adjacent said cabin and having means thereon for engaging the garbage can, said loader arm being pivotally movable with the garbage can through an arc extending from adjacent the ground level to said garbage can receiving opening to dump the garbage from the can into said loader housing, a pickup blade pivotally mounted on said loader housing adjacent the bottom of the transfer opening and having an end opposite the pivotal mounting extending substantially to the bottom of said loader housing, said pickup blade being pivotal to raise the garbage in the loader housing to the level of the transfer opening, a closing blade mounted on said garbage receiving container and said loader housing and being pivotally mounted adjacent the top of said transfer opening and being of a length to extend substantially to the bottom of the transfer opening and the inlet of said receiving container, said closing blade being pivotal to a position spaced from the transfer opening in a direction toward the garbage receiving opening so as to permit the pickup blade to lift the garbage dumped into the housing so as to place it in alignment with the transfer opening, said closing blade being pivotal backwardly toward the transfer opening to deflect the garbage off the pickup blade and to move it through the transfer opening into the garbage receiving container.

2. A garbage collecting and transport vehicle, according to claim 1, wherein said closing blade is of a size to close said garbage receiving container inlet.

3. A garbage collecting and transport vehicle, according to claim 1, wherein said loader arm comprises a single arm element mounted on only one side of said driver's cabin.

4. A garbage collecting and transport vehicle, according to claim 1, including a crossbeam rotatably mounted at the end of said garbage can loader arm and being rotated upon pivotal movement of said arm, a support arm carried on said crossbeam and being connectable to the garbage can at its outer end, said support arm being rotatable during movement of said loader arm to invert the garbage can and to position it to dump in the opening of said loader when said pivot arm moves in a direction from ground level toward said receiving opening of said loader.

5. A garbage collecting and transport vehicle, according to claim 1, wherein said closing arm is pivotally mounted on said garbage receiving container adjacent the top of the inlet opening thereof, said garbage receiving container being positionable on said chassis so as to project said closing arm into the transfer opening of said changing device, the top of said changing device being disposed obliquely and having an opening for receiving the garbage can and including means associated with said loader arm for inverting said garbage can during the upward pivotal movement of said loader arm to invert the can during the movement.

6. A garbage collecting and transport vehicle, according to claim 5, wherein said arm is pivotally mounted adjacent said cabin and extends forwardly in front of said cabin to pick up a garbage can arranged on the ground thereahead and is movable through an arc over said cabin to move the can over the cabin and into said loader housing, said loader housing being arranged directly adjacent said cabin wherein the garbage receiving opening is oriented to receive garbage from the front of said cabin.

7. A garbage collecting vehicle, comprising a wheeled chassis having a driver's cabin, a garbage loading housing affixed to said chassis and having a top with an opening for receiving the garbage and having an end wall with a transfer opening adjacent the top thereof, and means in said garbage loading device for raising garbage dumped therein up to the level of the transfer opening for discharge out of the device, a receiving container removably mounted on said chassis having an end wall with an inlet opening aligned with the transfer opening, a closure flap pivotally mounted on said receiving container to depend downwardly across the inlet opening and being movable outwardly from the opening to an open position, said means for elevating the garbage in said loader comprising a pivotal member movable upwardly to raise the garbage to the level of the transfer opening, said closing flap being movable in the return direction to deflect the garbage off the means for lifting it into the receiving container.

8. A garbage collecting vehicle, according to claim 7, including a dump member carried on said chassis supporting said receiving container being liftable to dump said receiving container, said receiving container having a discharge end opposite said inlet end, a gate pivotally mounted at the top of said discharge opening and closing the opening.

9. A garbage collecting vehicle, according to claim 8, wherein said means for lifting said container comprises a lift conveyor engageable with the container for pivoting it for dumping and for lifting it off said chassis.

* * * * *